US010249462B2

(12) United States Patent
Birner et al.

(10) Patent No.: US 10,249,462 B2
(45) Date of Patent: Apr. 2, 2019

(54) POWER RELAY FOR A VEHICLE

(71) Applicant: ELLENBERGER & POENSGEN GMBH, Altdorf (DE)

(72) Inventors: Markus Birner, Zirndorf (DE); Manuel Engewald, Nuremberg (DE); Ricardo Pimenta, Eckental (DE); Helmut Kraus, Berg (DE); Wolfgang Weiss, Altdorf (DE); Matthias Schwarz, Burgthann (DE); Sebastian Rothmayr, Nuremberg (DE); Thomas Singer, Berg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 302 days.

(21) Appl. No.: 15/357,181

(22) Filed: Nov. 21, 2016

(65) Prior Publication Data

US 2017/0069451 A1 Mar. 9, 2017

Related U.S. Application Data

(63) Continuation of application No. PCT/EP2015/001031, filed on May 21, 2015.

(30) Foreign Application Priority Data

May 21, 2014 (DE) ..... 10 2014 007 457

(51) Int. Cl.

| | |
|---|---|
| ***H01H 50/14*** | (2006.01) |
| ***H01H 1/58*** | (2006.01) |
| ***H01R 4/30*** | (2006.01) |
| ***H01H 50/54*** | (2006.01) |

(52) U.S. Cl.

CPC ..... *H01H 50/14* (2013.01); *H01H 1/5855* (2013.01); *H01H 50/54* (2013.01); *H01R 4/301* (2013.01); *H01H 2001/5894* (2013.01); *H01H 2231/026* (2013.01); *H01R 2201/26* (2013.01)

(58) Field of Classification Search

CPC ..... H01H 50/14; H01H 1/5855; H01H 50/54; H01H 4/301; H01H 2001/5894; H01H 2231/026; H01H 2201/26

See application file for complete search history.

(56) References Cited

U.S. PATENT DOCUMENTS 2,496,145 A * 1/1950 Bentley ..... H01H 1/5855 200/284
3,271,702 A * 9/1966 Book ..... H01P 1/125 200/504
4,595,871 A 6/1986 Koehler
(Continued)

FOREIGN PATENT DOCUMENTS

CN 101113711 A 1/2008
CN 102113078 A 6/2011
(Continued)

*Primary Examiner* — Mohamad Musleh
(74) *Attorney, Agent, or Firm* — Laurence A. Greenberg; Werner H. Stemer; Ralph E. Locher

(57) ABSTRACT

A power relay for a vehicle, in particular a utility vehicle, is disclosed. The power relay contains a housing formed by a connecting base and a housing pot that is placed on the connecting base. Accordingly, two connecting bolts for establishing contact with an on-load circuit are formed by standard screws.

10 Claims, 8 Drawing Sheets

(56) References Cited

U.S. PATENT DOCUMENTS

| | | | | | |
|---|---|---|---|---|---|
| 4,969,844 | A * | 11/1990 | Sako | H01H 50/14 | 335/202 |
| 5,521,566 | A * | 5/1996 | Krubsack | H01H 50/14 | 335/126 |
| 5,812,041 | A * | 9/1998 | Ishikawa | H01H 11/0031 | 200/284 |
| 7,772,944 | B2 * | 8/2010 | Kurasawa | F02N 11/00 | 335/126 |
| 2008/0136568 | A1 * | 6/2008 | Miyake | H01H 50/14 | 335/202 |
| 2011/0267157 | A1 | 11/2011 | Kalmbach et al. | | |
| 2011/0267158 | A1 | 11/2011 | Kalmbach et al. | | |

FOREIGN PATENT DOCUMENTS

| | | | |
|---|---|---|---|
| CN | 202150414 | U | 2/2012 |
| DE | 3933493 | A1 | 4/1990 |
| DE | 9001337 | U1 | 4/1990 |
| DE | 102010018738 | A1 | 11/2011 |
| DE | 102010018755 | A1 | 11/2011 |
| GB | 2229579 | A | 9/1990 |
| JP | H11215765 | A | 8/1999 |
| WO | 2004105068 | A1 | 12/2004 |

* cited by examiner

FIG. 4
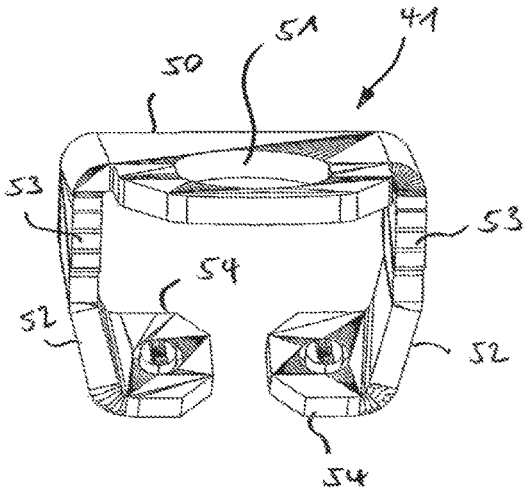
FIG. 5
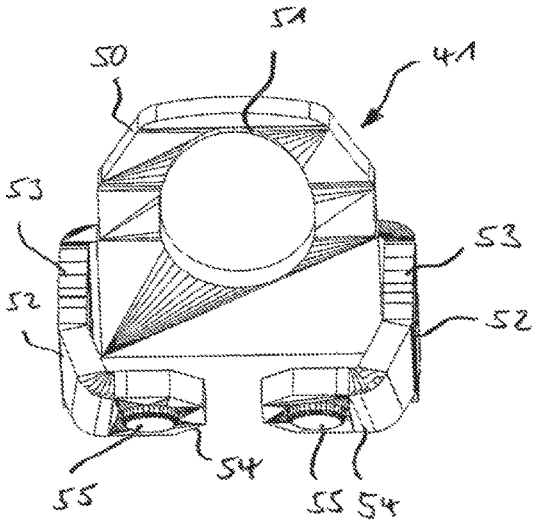
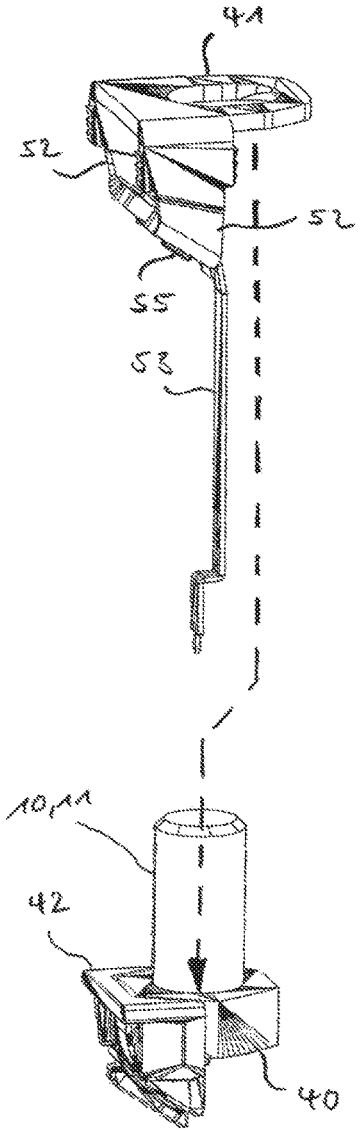
FIG. 6

POWER RELAY FOR A VEHICLE

CROSS-REFERENCE TO RELATED APPLICATION

This is a continuation application, under 35 U.S.C. § 120, of copending international application No. PCT/EP2015/001031, filed May 21, 2015, which designated the United States; this application also claims the priority, under 35 U.S.C. § 119, of German patent application No. 10 2014 007 457.9, filed May 21, 2014; the prior applications are herewith incorporated by reference in their entireties.

BACKGROUND OF THE INVENTION

Field of the Invention

The invention relates to a power relay for a vehicle, in particular a utility vehicle.

Power relays in accordance with the generic type are used in automotive engineering, in particular for utility vehicles. In this case, the power relays are used on the one hand so as to electrically separate the vehicle battery from the on-board power system. On the other hand, such relays are used so as to connect electric motors of adjusting devices (for example a hydraulic pump or lifting platform). In the case of a low voltage of typically 12 to 24 volt, such a power relay must be able to switch currents up to a current strength of approximately 300 ampere and must be of an accordingly robust construction. Relays usually used for this purpose are generally embodied from a pot-shaped body of metal (for example iron or steel) in which are accommodated a magnetic core, a magnetic yoke and a magnetic armature that is connected to a contact bridge (double contact).

In order to connect the power relay to a load current circuit that is to be switched in the vehicle, the power relay generally contains solid connection bolts (threaded bolts) that are embodied from metal and typically have a diameter of 0.5 to 1 cm. These connection bolts at which in the proper manner cable lugs of the connection lines of the load current circuit that is to be connected are defined in a contacting manner by screw nuts (contact nuts) are generally formed by special turned parts that are comparatively complex and consequently expensive to produce.

Power relays of the above described type are known in particular from published, non-prosecuted Germen patent applications DE 10 2010 018 755 A1 (corresponding to U.S. patent publication No. 2011/0267158), DE 10 2010 018 738 (corresponding to U.S. patent publication No. 2011/0267157)A1, DE 39 33 493 A1 (corresponding to U.S. Pat. No. 4,969,844) and U.S. Pat. No. 4,595,811.

German utility model DE 90 01 337 U1 discloses a further power relay in which the connection bolts are formed in each case by a screw having a hexagonal screw head. The screws are inserted from the housing interior into the through-going apertures of a housing socket so that each of the screws protrude outwards with their threaded shaft through the housing socket, whereas the hexagonal head lies in a corresponding receiving arrangement of the housing socket.

SUMMARY OF THE INVENTION

The object of the invention is to provide a power relay that can be produced in a particularly rational manner for a vehicle, in particular a utility vehicle.

This object is achieved in accordance with the invention by means of the features of the main claim. The power relay in accordance with the invention contains a housing that is formed from a connection socket and a housing pot that is placed thereon. Two connection bolts are inserted into the housing socket and by way of the connection bolts contact can be made between the power relay and the connection lines of an external load current circuit that is to be connected. In accordance with the invention, the connection bolts are formed by standard screws, in particular in accordance with ISO 4014 (or DIN 931-1) or ISO 4017 (or DIN 933). As is generally the case with screws, each connection bolt contains a threaded shaft—which is to be provided with a metal thread—and a screw head that is wider with respect to said connection bolt.

By virtue of using standard screws as the connection bolts, the production outlay and the production costs for the power relay are considerably reduced. Standard screws are commercially available as mass-produced items.

In order to be able to tighten the contact nuts in a simple manner as they make contact with the load current circuit, the respective screw head of the connection bolts preferably contains a non-circular outer contour. In particular, the screw head is formed in this case as a hexagonal head. The non-circular screw head holds the respective connection bolt in a non-rotatable manner in the connection socket by forming a form-locking connection with the connection socket. A form-locking connection is a connection based on the shape of the parts interacting with each other (e.g. a ball and socket).

In accordance with the invention, the connection bolts having the respective screw head lie loosely in a respective corresponding receiving arrangement of the connection socket. The term "loosely" is understood in this case to mean to such an extent that the connection bolts are not directly connected to the material of the connection socket. The connection bolts can as a result move slightly in particular with respect to the connection socket.

Each of the connection bolts is held in an expedient embodiment by a connecting conductor that is preferably formed by a bent sheet metal stamped part. Each of the connecting conductors is fixed in the connection socket and encompasses the outer face of the screw head so that the respective connection bolt is held in a loss-proof manner in the connection socket. The connecting conductors are used simultaneously to conduct the load current into the housing inner space.

In order to hold the respectively allocated connection bolt in the connection socket, each of the connecting conductors contains in an expedient construction a bore hole in a central section and the allocated connection bolt is guided with its threaded shaft through said bore hole. Each of the connecting conductors contains in an expedient manner on both sides of this central section in each case a fixing limb that is bent at 90° in particular with respect to the central section. The connecting conductor is fixed by the fixing limbs in the connection socket. In terms of a particularly simple process of producing the power relay, each of the connecting conductors is pressed by the fixing limbs in particular into the connection socket.

In a simple but simultaneously expedient embodiment, each connecting conductor also forms a fixed contact of the (main) switching device that is formed within the power relay for switching the load current circuit. For this purpose, one contact end is formed on at least one of the fixing limbs of each connecting conductor and the respective connecting conductor protrudes with the contact end into the housing inner space. The contact end supports a contact element of the switching device. It is preferred that in each case both fixing limbs of the connecting conductor is provided with contact ends that protrude into the housing inner space and support in each case a contact element. Consequently, each fixed contact is formed in a redundant manner by two parallel switched part contacts. In cooperation with a contact bridge, which forms the movable contact of the main switching device and in a closed position bridges the fixed contacts in an electrically conductive manner so as to close the load current circuit, a four-point contact is consequently produced in which the load current circuit is closed by way of a series connection of two respectively parallel connected contact point pairs. In comparison to a conventional two-point contact in which both fixed contacts are formed in each case only in a simple manner, a reduced transition resistance is achieved by this four-point contact in the through-connected (electrically conductive) state of the power relay.

It is preferred that each of the two contact ends of each connecting conductor is bent away from the adjacent fixing limb in such a manner that the contact elements that are arranged in each case on the contact ends are orientated in an inclined manner with respect to the housing axis. The mutually opposite contact elements of the fixed contacts are as a consequence in particular facing one another in an inclined manner. The inclined contact ends of the connecting conductors thus correspond to a contact bridge that is formed bent in the shape of the letter V or contains bridge ends that are at least bent in an inclined manner. The inclined position of the contact ends ensures that the contact elements of all four contact ends make contact with corresponding mating contact elements of the contact bridge.

In one expedient embodiment variant, the two contact ends of each connecting conductor are bent in each case towards one another. With the central section, the fixing limbs that are bent away from the central section, and the contact ends that are in turn bent with respect to the fixing limbs, each connecting conductor thus contains in simplified manner the shape of a frame that is slotted on one side and encompasses a spatial volume on four sides.

In order on the one hand to be able to insert, in particular press in, the connecting conductor that is configured in this manner into the connection socket, but in order on the other hand to prevent a hollow space, which would otherwise impair the stability of the power relay, from remaining within the connection socket, a filler element is allocated in an advantageous embodiment to each connecting conductor, wherein the filler element is embodied as a separate part from the connection socket and completely fills or at least fills around the edge of the volume that is encompassed by the connecting conductor. The filler element is used in this case in particular also so as to stabilize the allocated connecting conductor. It is preferred that the filler element is inserted into the respective connecting conductor during the production of the power relay. The component that is formed by the connecting conductor and the filler element is then pressed into the connection socket—after the allocated connection bolt has been inserted.

The connection socket is preferably a component that is injection molded from a synthetic material.

Other features which are considered as characteristic for the invention are set forth in the appended claims.

Although the invention is illustrated and described herein as embodied in a power relay for a vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 4 and 5 are perspective views of one of the connecting conductors as seen from two different directions;

FIG. 6 is a diagrammatic, perspective view of a procedure of assembling one of the connection bolts with the filler element, the connecting conductor and the auxiliary conductor;

DETAILED DESCRIPTION OF THE INVENTION

Figure 1:
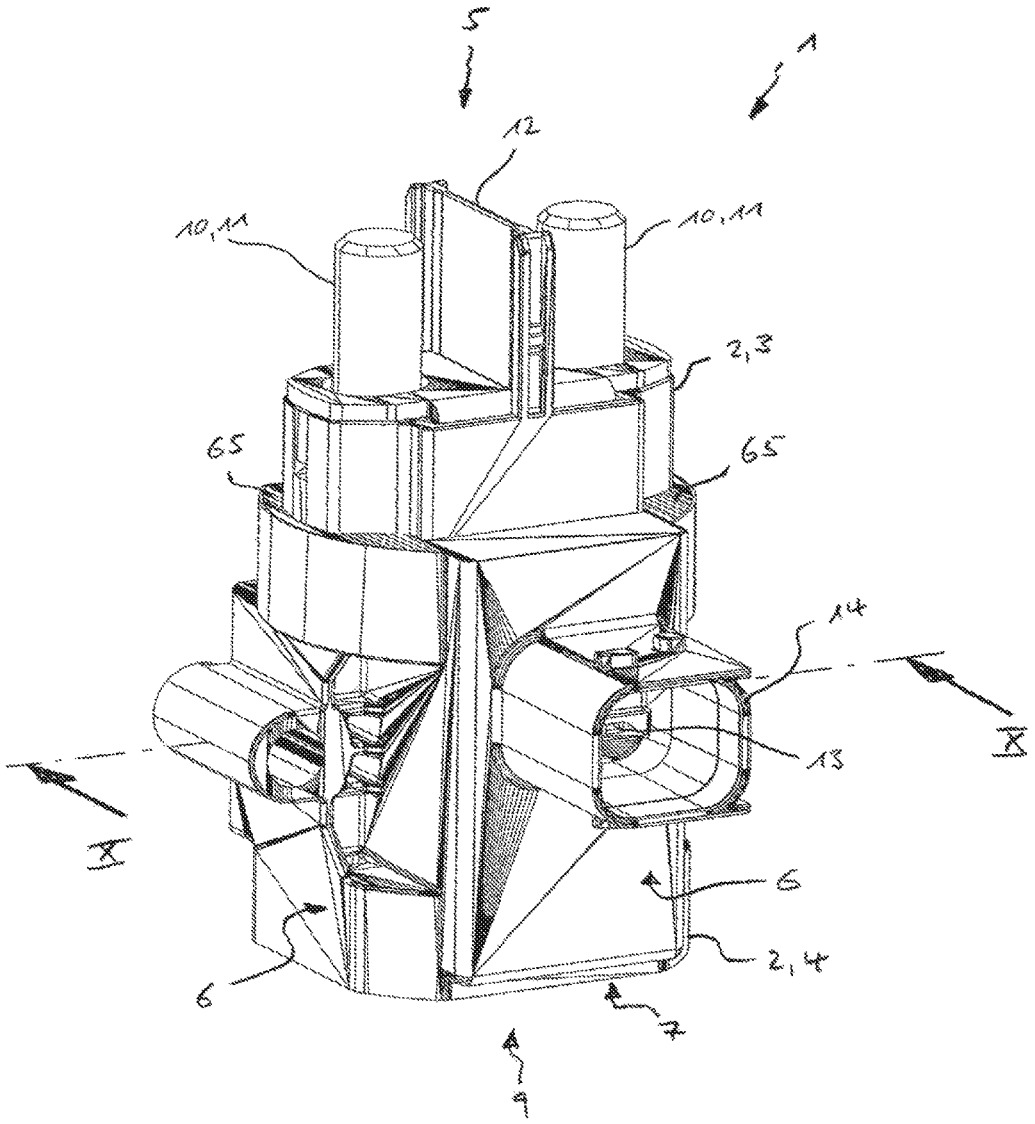
FIG. 1 is a perspective oblique view from above of a power relay for a heavy goods vehicle according to the invention.

Mutually corresponding parts are always provided in all figures with like reference numerals.

Referring now to the figures of the drawings in detail and first, particularly to FIG. 1 thereof, there is shown a power relay 1 that is illustrated as a complete unit in FIG. 1. The power relay contains a housing 2 that is formed from two parts, namely a connection socket 3 and a housing pot 4. Both the connection socket 3 and also the housing pot 4 are formed in this case as components that are injection molded from a synthetic material.

The connection socket 3 delimits the housing 2 with respect to a connection face and the power relay 1 can be connected on a connection face to an external load current circuit. This connection side is subsequently also referred to as the upper face 5—irrespective of the actual orientation of the power relay 1 in the surrounding space. The housing pot 4 encompasses with four side walls 6 and a housing base 7 the remaining faces of an approximately cuboid-shaped housing inner space 8 (see FIG. 10). In so doing, the housing base 7 closes the housing 2 with respect to a lower face 9 that is remote from the upper face 5, (wherein also the term "lower face" is used irrespective of the actual orientation of the power relay 1 in the surrounding space).

In order to connect two connection lines of the load current circuit that is to be connected, two solid connection bolts 10 are fixed in the connection socket 3 and the connection bolts protrude with a threaded shaft 11 outwards in each case from the housing 2. In order to connect the respective connection line of the load current circuit, an end-face cable lug of this connection line is placed on the allocated threaded shaft 11 and is contacted by the thread of a screw nut (contact nut).

In order to prevent an electrical flashover or any other short circuit between the connection bolt 10 and the connection lines of the load current circuit that are possibly fastened thereto, a partition wall 12 is formed on the outer face of the connection socket 3 and the partition wall protrudes into the intermediate space that is formed between the connection bolts 10.

In order to control the power relay 1, in other words to initiate the switching processes by which the power relay 1 is to be switched in—by virtue of producing inside the housing an electrically conductive connection between the connection bolts 10—or to be switched out—by virtue of separating this electrically conductive connection, multiple connections 13 are formed on the housing pot 4 and corresponding external signal lines can be connected in a clamped manner to the power relay 1 by way of the multiple signal connections. The signal lines are used so as to direct at least one electrical control signal to the power relay 1 and/or so as to output at least one electrical state signal by the power relay 1. As an option, at least one of the signal connections 13 is also provided so as to supply an electrical supply voltage, in particular ground. The signal connections 13 are embodied as contacts of a plug connector 14 that is formed as one piece on the wall of the housing pot 4.

Figure 2:
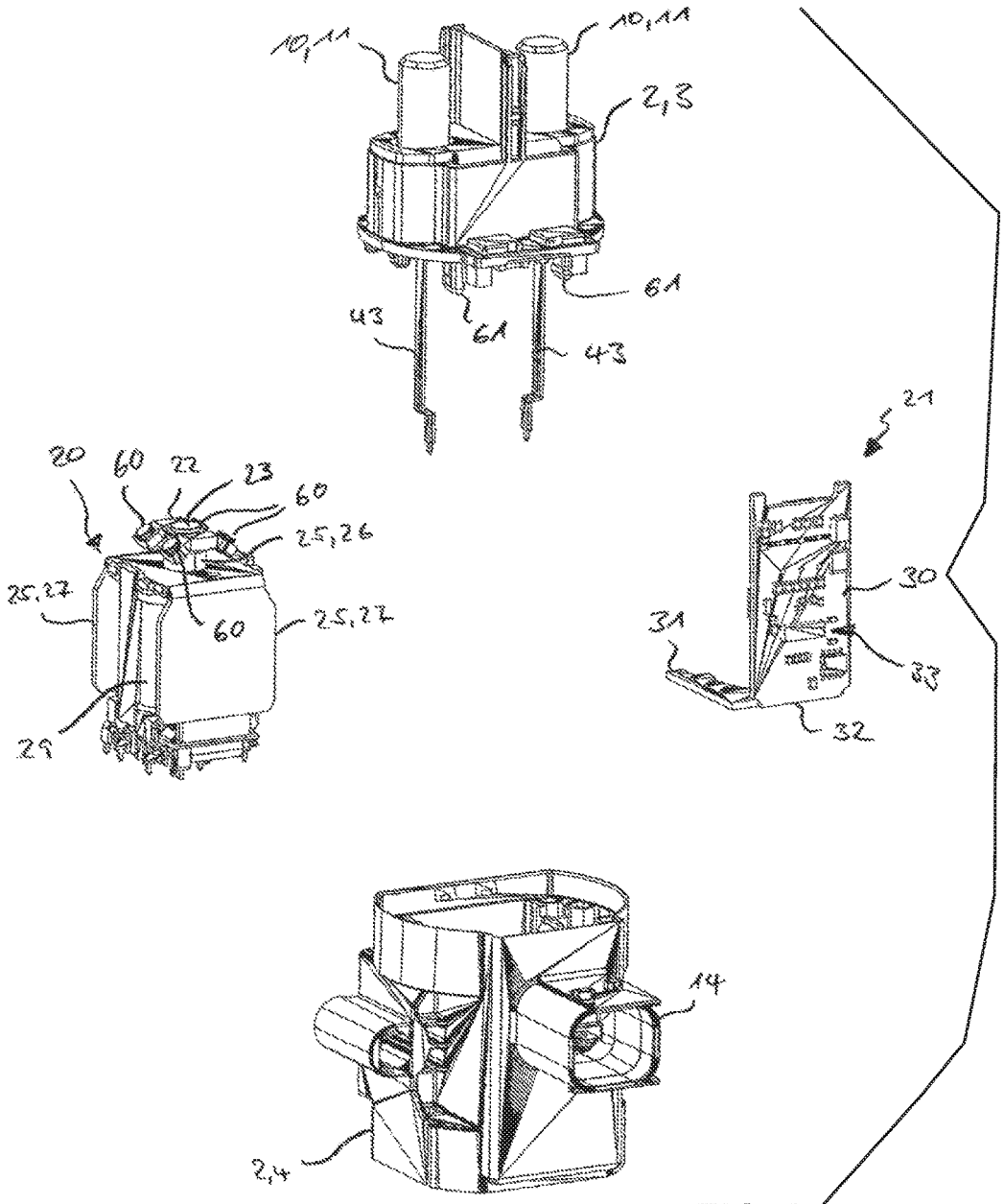
FIG. 2 is an exploded, perspective view of four sub-assemblies of the power relay, namely a connection socket, a housing pot, a coil assembly and a circuit board that supports an electronic control system.

FIG. 2 illustrates the power relay 1 in a partly disassembled state. It is evident in this illustration that the power relay 1 is formed from four assemblies that are associated with one another. In addition to the already described housing parts, namely the connection socket 3 with the connection bolts 10 attached thereto and also in addition to the housing pot 4 with the plug connector 14 formed as one thereon, the power relay 1 contains accordingly a coil assembly 20 and also a line carrier that is referred to hereinunder as a circuit board 21.

Figure 10:
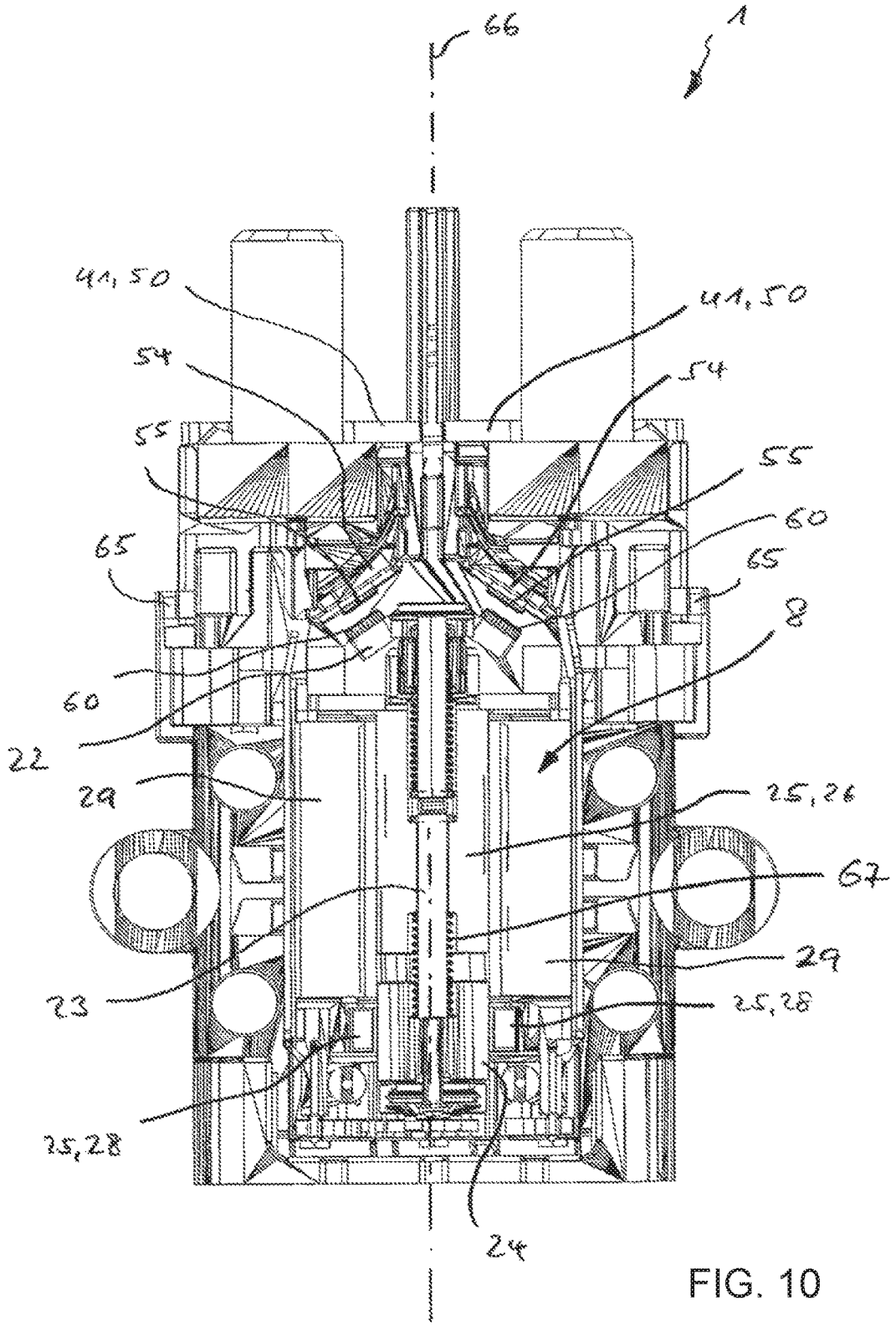
FIG. 10 is a cross-sectional view taken along the line X-X shown in FIG. 1 of the mounted power relay.

The coil assembly 20 contains a contact bridge 22 that is mechanically coupled by way of a coupling rod 23 to a magnetic armature 24 of a magnetic circuit, the magnetic armature being bent in the interior of the coil assembly 20 and only visible in FIG. 10. In addition to the magnetic armature 24, the magnetic circuit contains a magnetic yoke 25, wherein this magnetic yoke 25 is formed by a central, hollow-cylindrical core 26 that surrounds the coupling rod 23 in a concentric manner, a U-shaped bent bracket 27 and also two pole shoes 28 that extend towards one another from the limb ends of the bracket (FIG. 10). In so doing, the pole shoes 28 enclose the magnetic armature 24 between one another. The magnetic armature 24 and the components of the magnetic yoke 15 are formed from a ferromagnetic material.

The power relay 1 can be embodied in particular as a bi-stable relay. In this case, in each case one or multiple permanent magnets are arranged between the pole shoes 28 and the limb ends of the bracket 27. In the case of monostable variants of the power relay 1, the permanent magnets are replaced by a ferromagnetic material.

The coil assembly 20 contains furthermore a magnetic coil 29 that lies in the volume that is framed by the magnetic yoke 25. The magnetic coil 29 surrounds the core 26 of the magnetic yoke 25 in a concentric manner and for its part is framed by the bracket 27 and the pole shoes 28.

The circuit board 21 is formed from two sections 30 and 31 that are connected to one another in an articulated manner by way of a film hinge 32 and can therefore be bent out of an original planar state into the L-shaped arrangement that is illustrated in FIG. 2. In the case of the illustrated electronic construction of the power relay 1, the section 30 supports the electronic control system 33. The section 31 contains mainly contact sites so as to make electrical contact with the magnetic coil 29 and also so as to make contact with electrical functioning elements that are provided as an option so as to discharge the coils, display the switching position, overtemperature shut-down, etc.

As an alternative to the illustrated electronic construction of the power relay 1, purely electromechanical constructions of the power relay 1 are provided. In the case of these constructions, the circuit board 21 is preferably likewise provided. However, in this case, the circuit board does not support an electronic control system 33 but rather it only supports conductor tracks so as to connect the magnetic coil 29 and the possibly provided electrical functioning elements to the signal connections 13. As an alternative, the circuit board 21 is replaced by wire conductors in the case of purely electromechanical constructions of the power relay 1.

Figure 3:
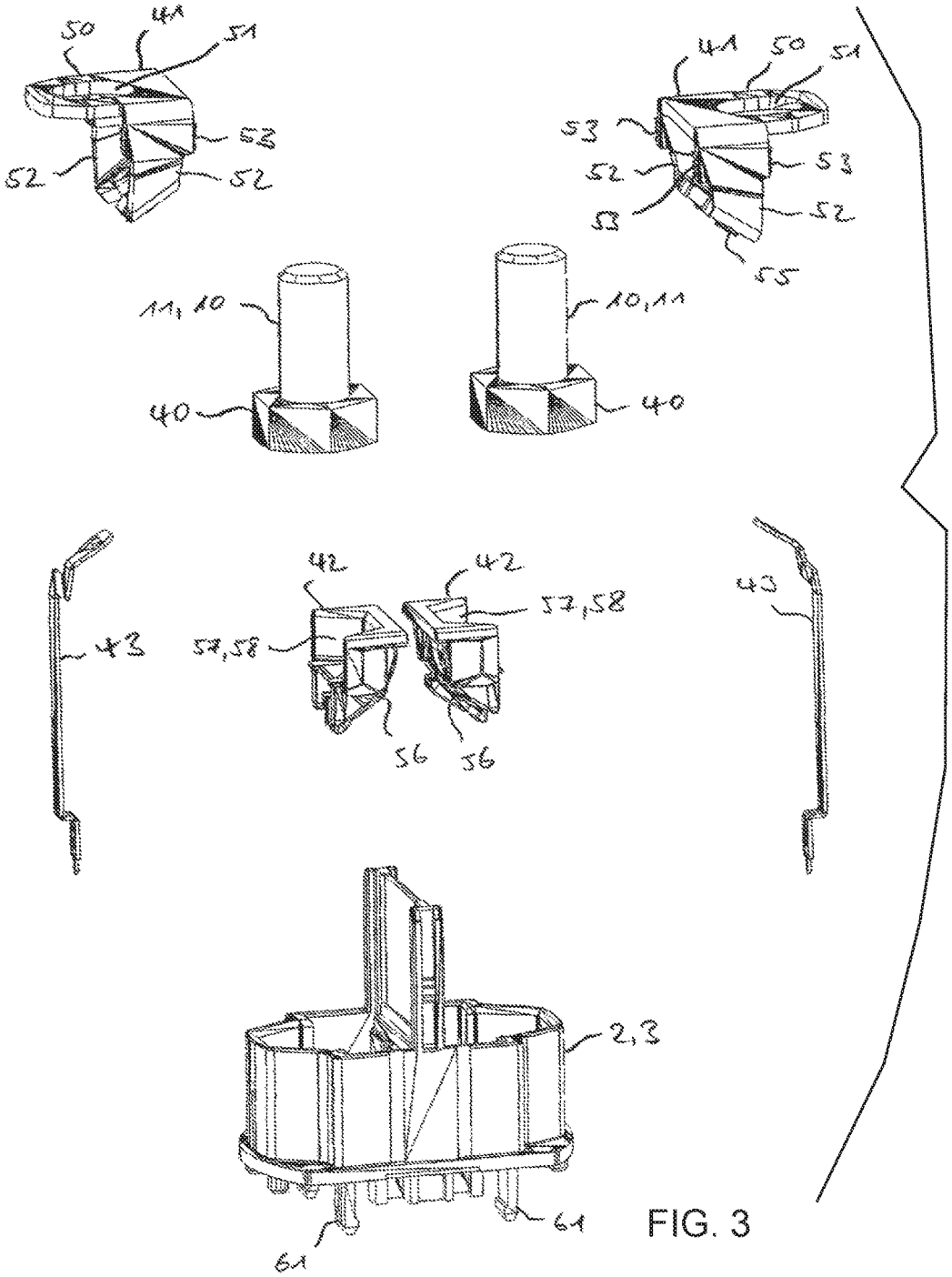
FIG. 3 is an exploded perspective view of the connection socket of the power relay and also two connection bolts having in each case an allocated connecting conductor, a respectively allocated filler element and a respectively allocated auxiliary conductor.

FIG. 3 illustrates an exploded view of the connection socket 3 with the connection bolts 10 and further components of the power relay 1 that in the proper assembled state of the power relay 1 are fixed to the connection socket 3. It is evident from the illustration that each of the two connection bolts 10 is formed by a standard screw having a hexagonal head 40. The connection bolts 10 are in this case in particular standard screws in accordance with ISO 4017, wherein the threaded shaft 11 is provided in each case with a metric thread (in particular M6, M8, M10 or M12) that extends as far as the hexagonal head 40. Each connection bolt 10 is allocated in each case a connecting conductor 41, a filler piece 42 and also an auxiliary conductor 43.

The auxiliary conductor 41 is used in this case to provide an electrical contact between the allocated connection bolt 10 and the housing inner space 8. As is particularly evident in FIGS. 4 and 5, that illustrate one of the connecting conductors 41 individually, each of the connecting conductors 41 is formed by a bent sheet metal stamped part. Each of the connecting conductors 41 contains a central section 50 that is formed in the shape of a bracket and is provided with a central bore hole 51 so as to receive the threaded shaft 11 of the allocated connection bolt 10. The two opposite-lying side edges of the central section 50 become in each case a fixing limb 52. The two fixing limbs 52 are used so as to fix the respective connecting conductor 41 in the connection socket 3. The fixing limbs 52 are bent in each case at an approximate right angle away from the central section 50 and are provided on their side edges with a respective saw-toothed contour 53. The ends of the two fixing limbs 52 of each connecting conductor 41, the ends being remote from the central section 50, are in turn bent by approximately 90° with respect to one another so that the connecting conductor 41 contains almost the shape of a frame or ring that is slotted on one side. The bent ends of the fixing limbs 52 are described hereinunder as the contact ends 54. Each contact end 54 supports a contact element 55 that is pressed in.

The filler pieces 42 are components that are injection molded. Each filler piece 42 is shaped on an outer face 56 in such a manner that it can be inserted with this outer face 56 in such a manner that it fits precisely into the volume that is encased by the associated connecting conductor 41. On an inner face 57 that lies opposite the outer face 56, a receiving arrangement 58 is formed in each of the two filler pieces 42 and so as to produce a form closure the hexagonal head 40 of the associated connection bolt 10 can be inserted into the receiving arrangement in such a manner that it fits precisely or with a small amount of play with slightly half of its circumference.

The auxiliary conductors 43 are bent sheet metal stamped parts that extend lengthwise.

Figure 7:
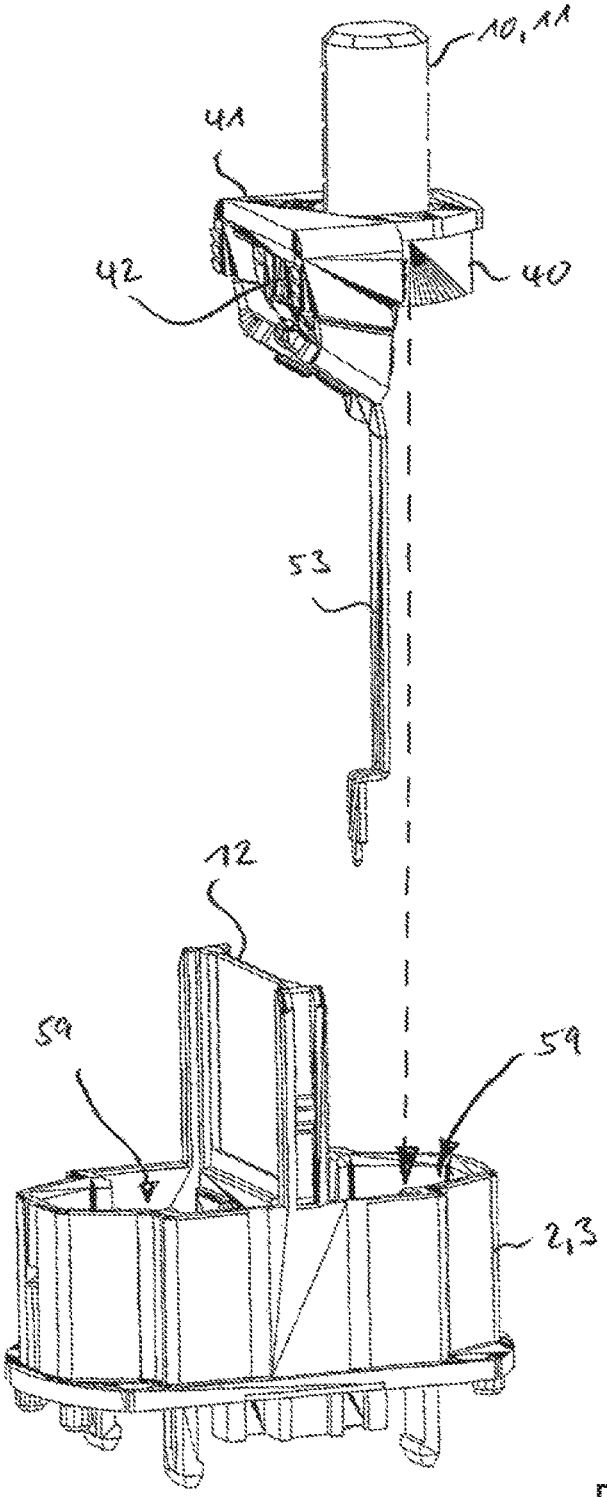
FIG. 7 is a perspective view of a procedure of assembling the connection socket with an assembly unit that is formed from the connection bolt, the filler element, the connecting conductor and the auxiliary conductor.

FIGS. 6 and 7 illustrate schematically the procedure of assembling the connection bolt 10, the connecting conductor 41, the filler element 42 and the auxiliary conductor 43 in the connection socket 3. As indicated, initially in each case one of the auxiliary conductors 43 is welded or riveted on the inner face (in other words on the face that lies opposite to the contact element 55) to one of the contact ends 54 of an allocated connecting conductor 41. Furthermore, in each case one of the connection bolts 10 having the hexagonal head 40 is inserted into the receiving arrangement 48 of the associated filler piece 42. Subsequently, the connecting conductor 41 with the auxiliary conductor 43 that is soldered on in accordance with FIG. 6 is slid onto the connection bolt 10 so that the connection bolt 10 having the threaded shaft 11 protrudes through the bore hole 51 of the connecting conductor 41, and that the connecting conductor 41 having the fixing limbs 52 and its contact ends 54 encompasses the filler piece 42. The assembly unit that is formed in this manner from the respective connection bolt 10, the associated connecting conductor 41, the filler piece 42 and the auxiliary conductor 43 is subsequently pressed from above into a corresponding receiving arrangement 59 of the housing pot 4 in accordance with FIG. 7, wherein the saw-toothed contours 53 that are provided on the fixing limbs 52 hook into the material of the housing pot 4.

Figure 8:
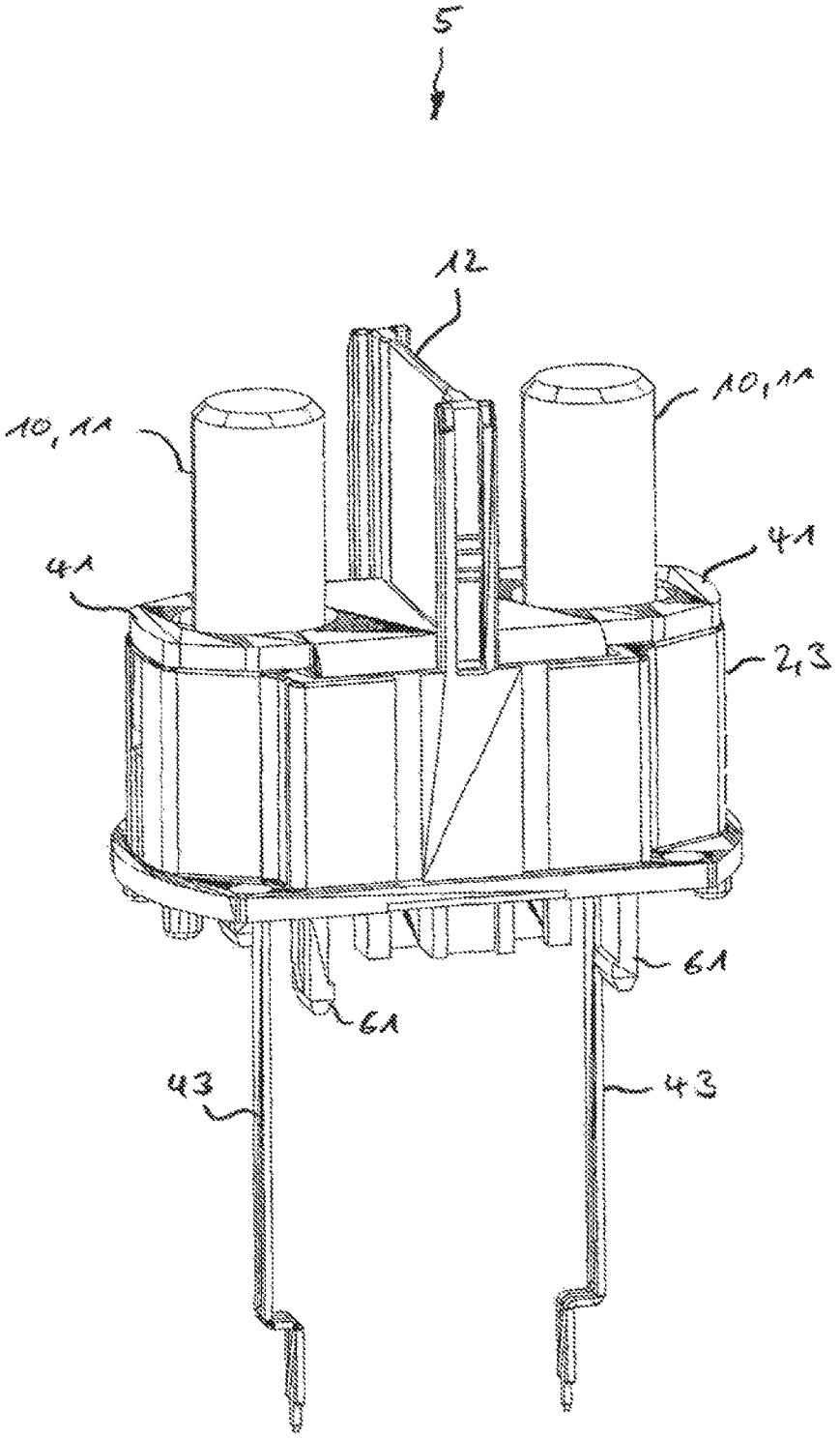
FIG. 8 is a perspective oblique view from above of an assembled connection socket.
Figure 9:
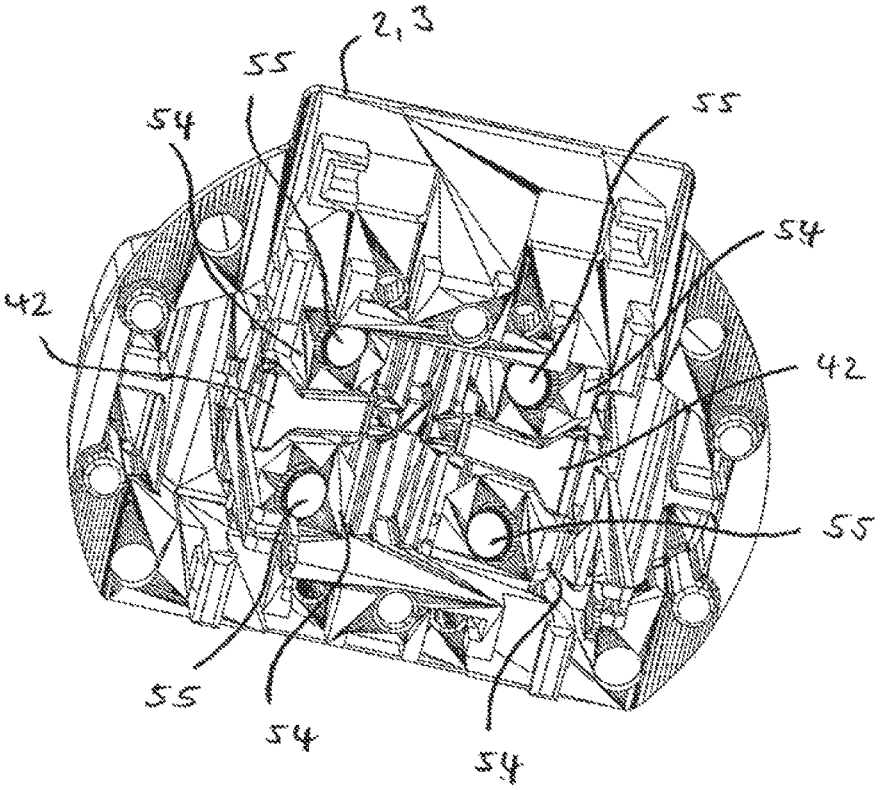
FIG. 9 is a perspective oblique view from below of a finished assembled connection socket.

FIGS. 8 and 9 illustrate the connection socket 3 in a finished assembled state. In this state, the connection bolts 10 having their hexagonal head 40 are received in each case in a positive-locking manner and a non-rotatable manner in the connection socket 3 so that the threaded shaft 11 of the connection bolts 10 protrudes in each case towards the upper face 5 outwards towards the connection socket 3. The connection bolts 10 are received loosely in the connection socket 3 and consequently are not connected to the material of the connection socket 3. In particular, the connection bolts 10 can also move slightly with respect to the connection socket 3. The connection bolts 10 are secured to prevent loss in this case only by means of the respective associated connecting conductor 41 that encompasses the outer face of the hexagonal head 40 with the central section 50.

In accordance with FIG. 9, the connecting conductors 41 protrude with their respective contact ends 54 at a lower face of the housing socket 3 into the housing inner space 8. The contact elements 55 that are attached in each case to the contact ends 54 thus form the fixed contacts of a main switching device of the power relay 1, the main switching device being provided so as to switch the load current circuit. The corresponding movable contact of this main switching device is formed by the contact bridge 22 of the coil assembly 20 that contains a mating contact element 60 (FIG. 2) that corresponds for this purpose to each contact element 55 of the connecting conductor 41.

In order to mount the power relay 1, the coil assembly 20 is clipped from below onto the previously assembled connection socket 3. For this purpose, the connection socket 3 is provided on its lower face with injection-molded snap-in hooks 61 (FIG. 2) that grip on both sides below the bracket 27 of the magnetic yoke 25.

The circuit board 21 is mounted after, prior to or simultaneously with clipping on the coil assembly 20. In particular, the auxiliary conductors 43 and the coil connections (not explicitly illustrated) of the magnetic coil 29 are soldered to the corresponding contact sites on the section 31 of the circuit board 21. Subsequently, the housing pot 4 is placed over the coil assembly 20 and the circuit board 21 and screwed to the connection socket 3, as a consequence of which the housing 2 is closed. In order to seal the housing 2, a casting compound 65 (FIGS. 1 and 10) is poured over the connection between the connection socket 3 and the housing pot 4.

As is evident in FIG. 10, in the finished assembled state of the power relay 1, the contact elements 55 of the connecting conductor 41 lie in each case opposite to a mating contact element 60 of the contact bridge 22. The mating contact elements 60 are electrically short circuited within the contact bridge 22. It is furthermore evident in FIG. 10 that the contact ends 54 of the connecting conductor 41 are bent away from the respective adjacent fixing limb 52 in such a manner that they are inclined with respect to the respective associated central section 50, and consequently are also arranged in an inclined manner with respect to a housing axis 66 of the power relay 1. Taken together, the contact ends 54 thus form a saddleback roof-type structure. The contact elements 55 that are attached to the face of the contact ends 54 that is facing the housing inner space 8 are as a consequence facing one another in an inclined manner.

So as to match the arrangement of the contact elements 55, the contact bridge 22 also contains a V-shaped or roof-shaped structure with ends that are bent in an inclined manner so that the mating contact elements 60 are arranged parallel to the corresponding contact elements 55. The inclined position of the contact elements 55 and the corresponding mating contact elements 60 facilitates in this manner a good contact connection of all four contact elements 55 with the corresponding mating contact elements 60.

FIG. 10 illustrates the power relay 1 in an open position in which the mating contact elements 60 are raised from the contact elements 55 (in other words the contact is broken) so that the connection bolts 10 are not connected in an electrically conductive manner. The magnetic coil 29 is energized so as to switch on the power relay 1. As a consequence, a magnetic flux is generated in the magnetic yoke 25 by which the magnetic armature 24 is drawn against the core 26 of the magnetic yoke 25. The magnetic armature 24 is used together with the coupling rod 23 to deflect the contact bridge 22 upwards so that the mating contact elements 60 abut against the corresponding contact elements 55. A conductive connection between the connecting bolts 10 is formed by way of the contact bridge 22 when the power relay 1 is in the closed position that is produced in this manner.

In order to switch off the power relay 1, the magnetic coil 29 is energized with the reversed polarity. Under the influence of the magnetic flux that is generated in the magnetic yoke 25, the holding force that is generated by the permanent magnets 29 is compensated for, as a result of which the magnetic armature 24 is separated from the core 26 by a restoring spring 67 (FIG. 10) and consequently pushed into the open position in accordance with FIG. 10. In so doing, the magnetic armature 24 entrains in turn the contract bridge 22 by way of the coupling rod 23, as a consequence of which—by separating the electrical connection between the connection bolts 10—the contact between the mating contact elements 60 and the corresponding contact elements 55 is broken.

In the illustrated bi-stable construction of the power relay 1, each of the two switching positions of the power relay 1 is also stable in the non-energized state of the magnetic coil 29. In this case, it is only necessary to energize the magnetic coil 29 temporarily.

A supply voltage for the electronic control system 33 is supplied to the circuit board 21 by way of the auxiliary conductor 43. Furthermore, when the power relay 1 is in the switched-on state, the electronic control system 33 uses the potential that is tapped by way of the auxiliary conductor 43 to ascertain the voltage that is dropping between the connection bolts 10 as a measurement for the current strength of the load current that is flowing through the power relay 1 in order to automatically switch off the power relay 1 in the event of an overload or short circuit.

The invention is particularly clarified with reference to the above described exemplary embodiment but nonetheless is not limited to this exemplary embodiment. On the contrary, numerous further embodiments of the invention can be derived from the claims and the above description.

The following is a summary list of reference numerals and the corresponding structure used in the above description of the invention:

1 Power relay
2 Housing
3 Connection socket
4 Housing pot
5 Upper face
6 Side wall
7 Housing base
8 Housing inner space
9 Lower face
10 Connection bolt
11 Threaded shaft
12 Partition wall
13 Signal connection
14 Plug connector
20 Coil assembly
21 Circuit board
22 Contact bridge
23 Coupling rod
24 Magnetic armature
25 Magnetic yoke
26 Core
27 Bracket
28 Pole shoe
29 Magnetic coil
30 Section
31 Section
32 Film hinge
33 Electronic control system
40 Hexagonal head
41 Connecting conductor
42 Filler piece
43 Auxiliary conductor
50 Central section
51 Bore hole
52 Fixing limb
53 Saw-toothed contour
54 Contact end
55 Contact element
56 Outer face
57 Inner face
58 Receiving arrangement
59 Receiving arrangement
60 Mating contact element
61 Snap-in hooks
65 Casting compound
66 Housing axis
67 Restoring spring

The invention claimed is:

1. A power relay for a vehicle, the power relay comprising:

a housing formed from a connection socket and a housing pot that is disposed on said connection socket, said connection socket having a receiving arrangement and connecting conductors; and two connection bolts inserted into said connection socket so as to make contact with a load current circuit, said connection bolts each having a screw with a threaded shaft and a screw head, each of said connection bolts having said screw head disposed loosely in said receiving arrangement of said connection socket so that said threaded shaft protrudes outwards from said connection socket, each said screw head is encompassed on an outer face by one of said connecting conductors of said connection socket and consequently is held in a secure manner in said receiving arrangement.

2. The power relay according to claim 1, wherein said screw head of each of said connection bolts has a non-circular outer contour.

3. The power relay according to claim 1, wherein:

each of said connecting conductors has a bore hole formed therein in a central section and each of said connection bolts having said threaded shaft is guided through said bore hole; and each of said connecting conductors have two fixing limbs with one of said fixing limbs disposed on each side of said central section, said fixing limbs are fixed in said connection socket.

4. The power relay according to claim 3, wherein each of said connecting conductors having said fixing limbs is pressed into said connection socket.

5. The power relay according to claim 3, wherein:

in each case said two fixing limbs of each of said connecting conductors protrude with a contact end into a housing inner space that is enclosed by said housing; and each said contact end has in each case a contact element of a switching device for switching the load current circuit.

6. The power relay according to claim 5, wherein said contact end of each of said connecting conductors is disposed in an inclined manner with respect to said central section so that said contact element that is disposed in each case on said contact end is disposed in an inclined manner with respect to a housing axis.

7. The power relay according to claim 5, wherein said contact end of each of said connecting conductors is in each case bent towards one another.

8. The power relay according to claim 7, further comprising filler elements, each of said connecting conductors is allocated one of said filler elements that is separate from said connection socket and that completely fills or at least surrounds at least around an edge of a volume that is encompassed by said connecting conductor.

9. The power relay according to claim 1, wherein said connection socket is embodied as a component that is injection molded from a synthetic material.

10. The power relay according to claim 1, wherein said screw head of each of said connection bolts has a hexagonal outer contour.

* * * * *